US008850622B2

(12) United States Patent
Finiel et al.

(10) Patent No.: US 8,850,622 B2
(45) Date of Patent: Oct. 7, 2014

(54) DEFORMABLE SAFETY HELMET

(75) Inventors: Rémi Finiel, Rolle (CH); Shaw Kaake, Shanghai (CN); Ku Cheng-Huei, Zhejiang (CN); Xiang Zi Ping, Zhejiang (CN); Roger Davis, Shanghai (CN)

(73) Assignee: Kuji Sports Ltd., Taipei (TW)

( * ) Notice: Subject to any disclaimer, the term of this patent is extended or adjusted under 35 U.S.C. 154(b) by 3 days.

(21) Appl. No.: 13/201,381

(22) PCT Filed: Feb. 11, 2010

(86) PCT No.: PCT/FR2010/000108

§ 371 (c)(1),
(2), (4) Date: Nov. 4, 2011

(87) PCT Pub. No.: WO2010/092254

PCT Pub. Date: Aug. 19, 2010

(65) Prior Publication Data

US 2012/0047635 A1 Mar. 1, 2012

(30) Foreign Application Priority Data

Feb. 13, 2009 (FR) ..... 09 00674

(51) Int. Cl.

| | |
|---|---|
| ***A42B 3/04*** | (2006.01) |
| ***A42B 3/12*** | (2006.01) |
| ***A42B 3/14*** | (2006.01) |
| *A42B 3/00* | (2006.01) |

(52) U.S. Cl.

CPC ..... *A42B 3/125* (2013.01); *A42B 3/145* (2013.01); *A42B 3/14* (2013.01); *A42B 3/00* (2013.01); *A42B 3/12* (2013.01)

USPC ..... 2/410; 2/418; 2/414; 2/411; 2/412

(58) Field of Classification Search

CPC ..... A42B 3/14; A42B 3/145; A42B 3/12; A42B 3/00; A42B 1/08; A42B 3/324; A42B 3/06; A42B 3/10; A42B 3/125; A42B 3/063; Y10S 2/909; A42C 2/00

See application file for complete search history.

(56) References Cited

U.S. PATENT DOCUMENTS

| | | | | |
|---|---|---|---|---|
| 532,567 | A * | 1/1895 | Larwood, Jr. | 2/421 |
| 2,706,294 | A * | 4/1955 | Sprinkle | 2/414 |

(Continued)

FOREIGN PATENT DOCUMENTS

| | | | |
|---|---|---|---|
| DE | 88 04 821 | U1 | 6/1988 |
| DE | 100 29 374 | A1 | 12/2000 |
| FR | 2 904 197 | A1 | 2/2008 |

OTHER PUBLICATIONS http://www.engineersedge.com/manufacturing_spec/average_properties_structural_materials.htm; Table of modulus of common materials, copyright 2000-2013.*

(Continued)

*Primary Examiner* — Bobby Muromoto, Jr.
(74) *Attorney, Agent, or Firm* — Oliff PLC

(57) ABSTRACT

A safety helmet includes damping elements for example made from expanded polystyrene added onto a shell made from an elastically deformable material. The whole of the surface, facing the shell, of the damping elements arranged along the periphery of the opening is positioned against the shell to form an inner supporting belt completely in contact with the shell. The helmet is arranged in such a way that a position of the head in the cavity of the helmet causes a deformation of the supporting belt by elastic deformation of the shell according to the morphology of the head, generating permanent tightening of the supporting belt against the head in substantially uniform manner along the supporting belt.

5 Claims, 6 Drawing Sheets

(56) References Cited

U.S. PATENT DOCUMENTS

| | | | | | |
|---|---|---|---|---|---|
| 2,969,547 | A | * | 1/1961 | Dye | 2/411 |
| 2,983,923 | A | * | 5/1961 | Aileo | 2/418 |
| 3,153,792 | A | * | 10/1964 | Marietta | 2/414 |
| 3,241,154 | A | * | 3/1966 | Aileo | 2/419 |
| 3,329,968 | A | * | 7/1967 | Gordon | 2/418 |
| 3,465,363 | A | * | 9/1969 | Raney | 2/420 |
| 3,486,169 | A | * | 12/1969 | Rawlings | 2/414 |
| 3,787,894 | A | * | 1/1974 | Goodman, Jr. | 2/418 |
| 3,994,020 | A | * | 11/1976 | Villari | 2/413 |
| 4,710,984 | A | * | 12/1987 | Asper et al. | 2/412 |
| 5,337,420 | A | * | 8/1994 | Haysom et al. | 2/410 |
| 5,511,250 | A | * | 4/1996 | Field et al. | 2/418 |
| 5,575,017 | A | * | 11/1996 | Hefling et al. | 2/418 |
| 5,694,649 | A | * | 12/1997 | Hefling et al. | 2/418 |
| 5,815,847 | A | * | 10/1998 | Holden, Jr. | 2/418 |
| 5,867,840 | A | * | 2/1999 | Hirosawa et al. | 2/414 |
| 5,930,840 | A | * | 8/1999 | Arai | 2/411 |
| 6,085,357 | A | * | 7/2000 | Broersma | 2/416 |
| 6,128,786 | A | * | 10/2000 | Maddux et al. | 2/418 |
| 6,240,571 | B1 | * | 6/2001 | Infusino | 2/414 |
| 6,317,895 | B1 | * | 11/2001 | Erth et al. | 2/411 |
| 6,665,884 | B1 | | 12/2003 | Demps et al. | |
| 6,865,752 | B2 | * | 3/2005 | Udelhofen et al. | 2/425 |
| 6,925,657 | B2 | * | 8/2005 | Takahashi et al. | 2/412 |
| 2004/0025229 | A1 | * | 2/2004 | Takahashi et al. | 2/412 |
| 2004/0093660 | A1 | * | 5/2004 | Bostock | 2/416 |
| 2006/0048284 | A1 | * | 3/2006 | Kapah | 2/411 |
| 2008/0052808 | A1 | * | 3/2008 | Leick et al. | 2/411 |
| 2008/0250549 | A1 | * | 10/2008 | Summers et al. | 2/425 |

OTHER PUBLICATIONS

International Search Report in International Application No. PCT/FR2010/000108; Jun. 4, 2010 (with English-language translation).

* cited by examiner

DEFORMABLE SAFETY HELMET

BACKGROUND OF THE INVENTION

The invention relates to a safety helmet delineating a cavity open onto the outside through an opening to engage the head in the cavity, comprising an external shell in a single part, a plurality of damping elements added-on to the inside of the shell, and joining means to join the damping elements to one another.

STATE OF THE ART

A safety helmet of this type is known from the document U.S. Pat. No. 6,665,884B1 which provides a rigid shell only deforming under the effect of an external impact. Lateral, front and top damping elements are added inside the shell. Each of the lateral elements is subdivided into a lateral part fixed to the shell and a rear part articulated freely on the lateral part. Each lateral damping element is therefore partially fixed to the shell. The free ends of the rear parts are joined to one another by a flexible band. The rear parts and the flexible band are situated at a distance from the internal surface of the shell. This results in the presence of dead volumes located between the shell and the damping elements, which does not make for optimal protection. The front damping element is completely dissociated from the lateral damping elements, with interposition of empty spaces at the level of which no tightening is applied to the head in position in the cavity of the shell. Tightening on the head is only performed laterally and from the rear, which means that the hold of the helmet on the head and the protection afforded are debatable. Finally, the tightening function is performed by the rear flexible band and by the compressibility of the lateral damping elements. The shell situated at a distance from these parts with interposition of dead volumes as indicated above does not participate in tightening on the head and does not present any possible adjustment to the morphology of the user's head. Only the lateral elements adjust to the morphology of the head.

Furthermore, shocks on a helmet when falling are seldom purely perpendicular to the shell and it frequently happens that a component tangential to the shell causes of violent torsional torque on the head and then on the neck. These sudden rotations of the head cause internal injuries to the elements joining the brain to the top. Helmets of the prior art do not provide protection against this phenomenon, and they are not completely satisfactory as far as the safety question is concerned.

OBJECT OF THE INVENTION

The object of the invention consists in providing a safety helmet whereby the comfort, strength, aesthetics and safety are optimized whatever the morphology of the user's head.

This object is achieved by a helmet according to the appended claims, in particular by the fact that the damping elements are formed by a material forming a rigid foam, that the shell is made from elastically deformable material, and that the whole of the surface, facing the shell, of the damping elements arranged along the periphery of the opening is positioned against the inner surface of the shell so as to form an inner supporting belt completely in contact with the shell, the helmet being arranged in such a way that a position of the head in the cavity causes a deformation of the supporting belt by elastic deformation of the shell according to the morphology of the head, generating permanent tightening of the supporting belt in substantially uniform manner against the head along the supporting belt.

The damping elements located at the periphery of the opening are for example positioned side by side so to form a supporting belt bordering the whole of the periphery of the opening in order to avoid any empty spaces along the periphery of the opening. As the whole of the surface of the damping elements at the periphery of the opening facing the shell is positioned against the shell, this results in the absence of dead volumes located between the shell and the damping elements, thereby providing optimal protection. The shell is designed to deform elastically in flection when the head is in position in the cavity of the helmet to generate tightening of the supporting belt against the head, by elastic return of the shell to its natural configuration before the head was placed in the cavity. The shell therefore automatically adjusts to the morphology of the user's head. All of the damping elements bordering the periphery of the opening participate in tightening and adjust to the morphology of the head. A supporting belt formed in this way and arranged so as to deform when the head is in position in the cavity of the helmet, by deformation of the shell against which it is completely pressing, has the effect of clamping the head in permanent and uniform manner over the circumference of the belt, which makes for an improved hold of the helmet on the head and enhanced protection.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF PREFERRED EMBODIMENTS OF THE INVENTION

Figure 1:
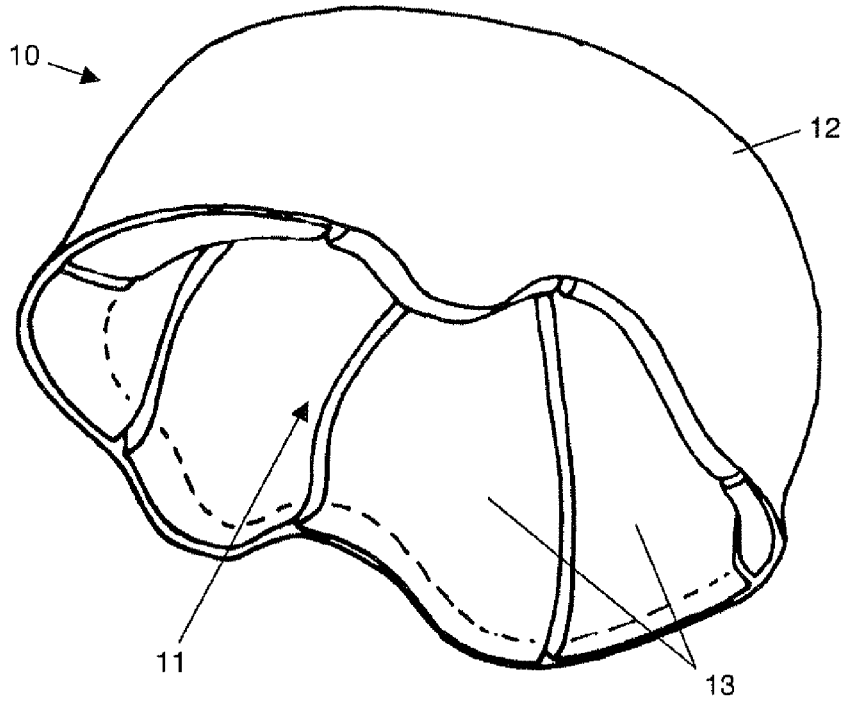
FIG. 1 is a perspective bottom view of a helmet according to the invention.
Figure 2:
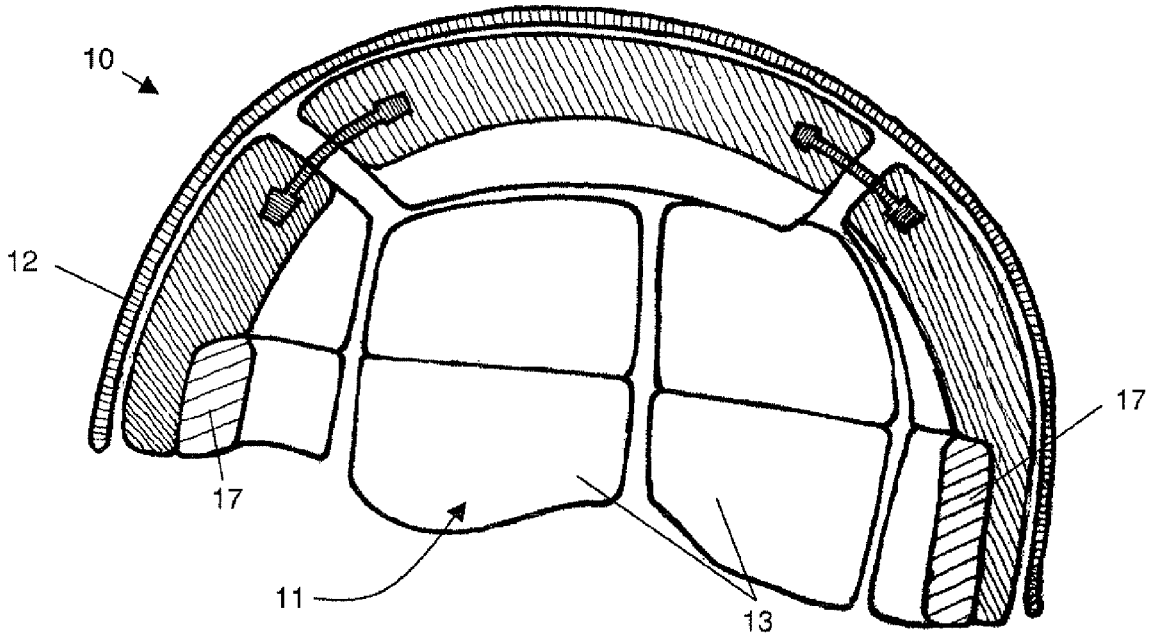
FIG. 2 is a longitudinal cross-section of the helmet of FIG. 1.

Safety helmet 10 of FIGS. 1 and 2 delineates a cavity open onto the outside through an opening 11 to engage the head inside the cavity. Helmet 10 comprises an outer shell 12 in a single part and devoid of notches. A plurality of damping elements 13 are added inside shell 12 so as to form a damping liner substantially covering the whole of the inner surface of shell 12. Joining means can be provided to join damping elements 13 to one another, but such joining means are not indispensable. It is possible to provide for each damping element 13 to be attached to the shell without being connected with the other damping elements 13.

What should be understood by "notch" is a local elongate removal of material over the whole thickness of the helmet (i.e. over the whole thickness of the foam liner and over the whole thickness of the shell) arranged in such a way as to open out onto the edges of the helmet. Shell 12 can however comprise local ventilation openings having a closed outline, i.e. not opening out onto the edges of the helmet.

Damping elements 13 are made from expanded polystyrene (PSE) or any other substantially rigid foam which presents an economic interest comparable to that of PSE or interesting damping properties. Shell 12 is for its part made from elastically deformable material such as a thermoplastic polymer material, such as polycarbonate, acrylonitrile butadiene styrene (or ABS), polystyrene, polyethylene terephtalate glycol (or PETG), or polyvinyl chloride (or PVC), The choice of the material of shell 12 is such that shell 12 presents a satisfactory resistance to external impacts and that the bending modulus of the material is comprised between 1500 and 4500 MPa. For a required flexible deformability in flection, the thickness of outer shell 12 is for example comprised between 0.5 and 3 mm, according in particular to the modulus of elasticity. The material forming shell 12 also presents a tensile breaking elongation characteristic which is preferably greater than 10%.

When they are used, the joining means between damping elements 13 can be achieved in any manner, and are for example designed to allow relative movements between damping elements 13.

Figure 3:
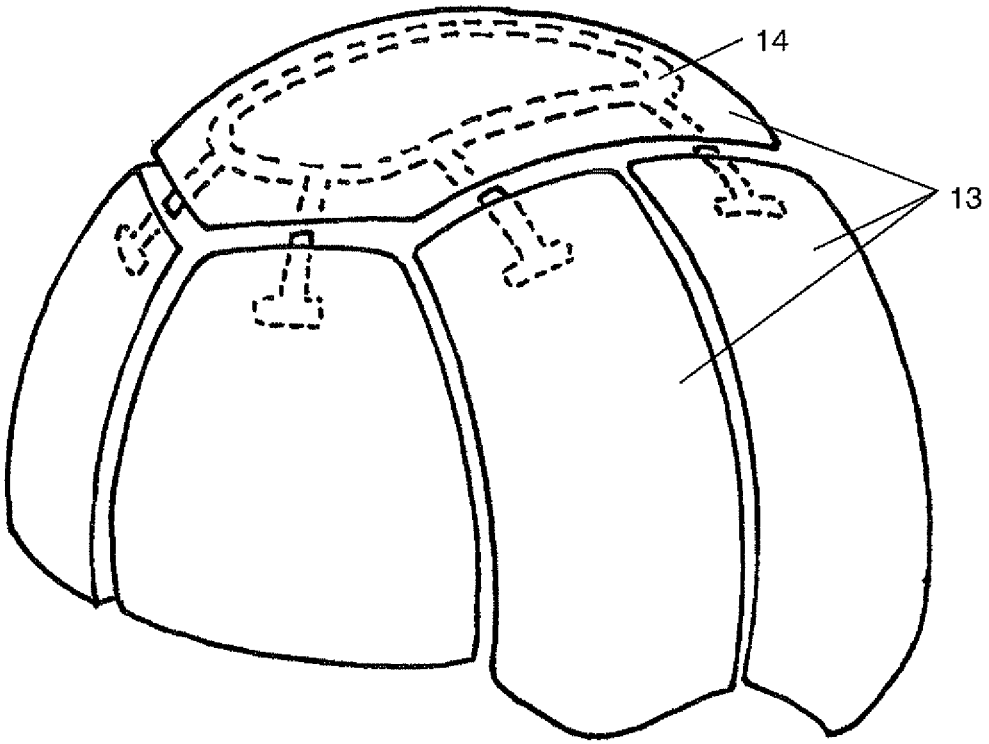
FIGS. 3 to 6 illustrate different alternative embodiments of joining means between the damping elements.
Figure 5:
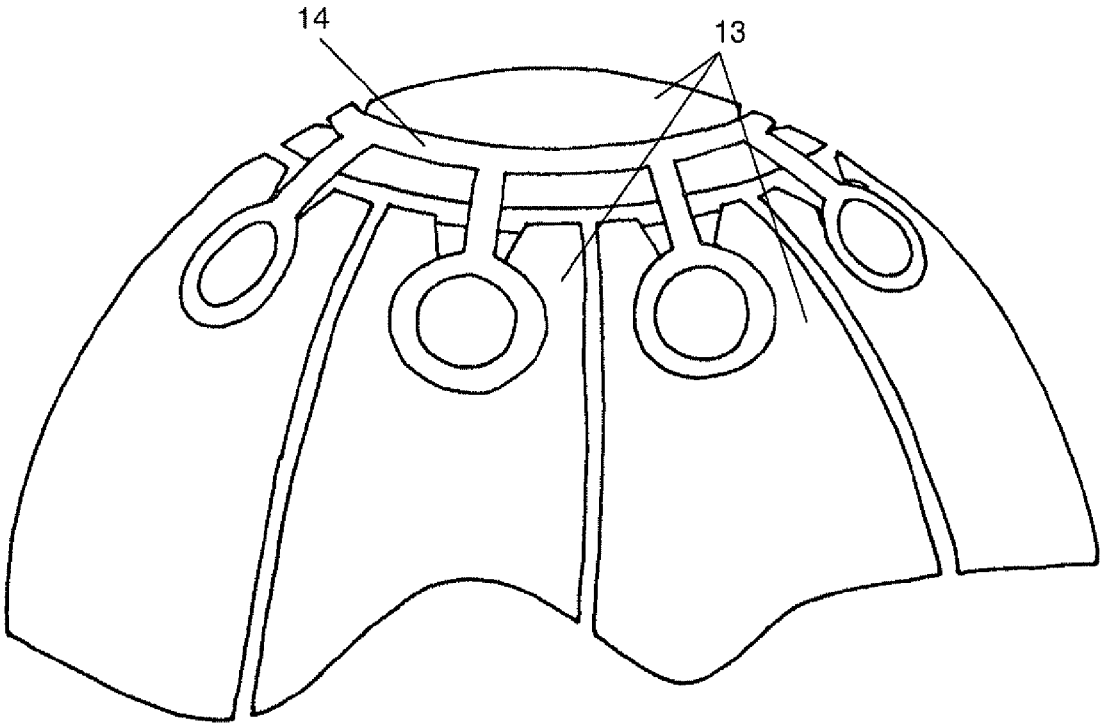

A first solution consists in using a single structure 14 connecting all of damping elements 13 to one another. In the case where the damping liner is formed by a top damping element around which a plurality of lateral, front and rear damping elements are angularly arranged, single structure 14 can for example be in the form of a spider the head of which is fixed to the top damping element and each leg of which performs joining between the top damping element and a peripheral damping element. In FIG. 3, the top, lateral, front and rear damping elements are achieved by overmoulding on single structure 14. In FIG. 5 on the other hand, single structure 14 is not overmoulded, but is imprisoned between damping elements 13 and the inner surface of outer shell 12.

Figure 4:
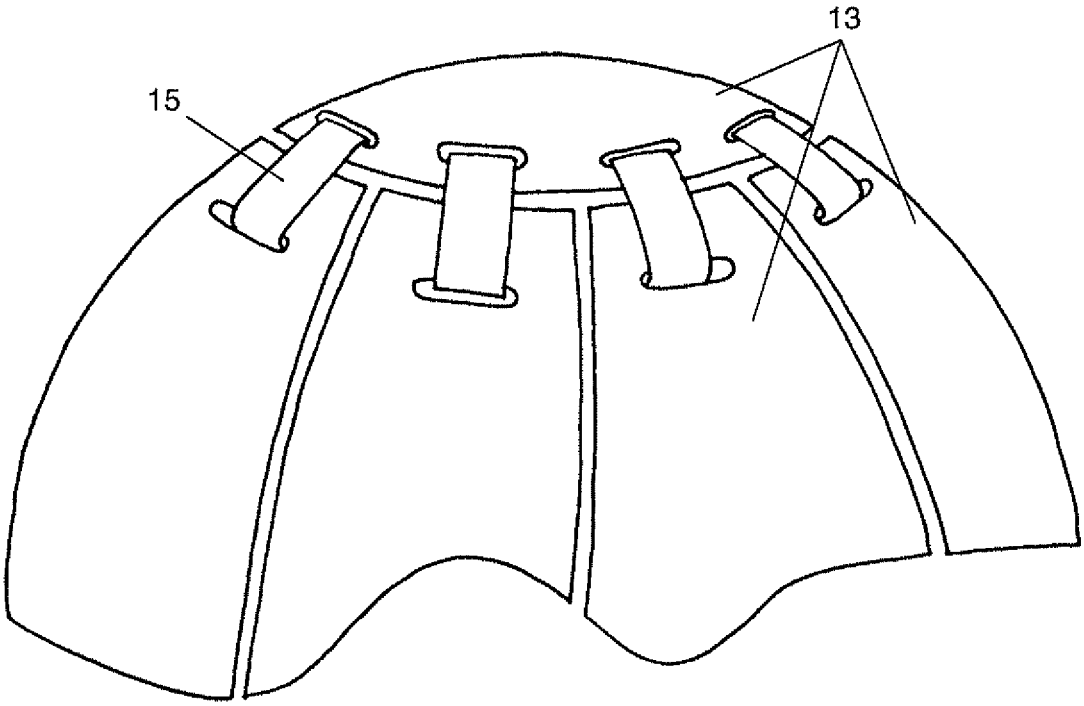
Figure 6:
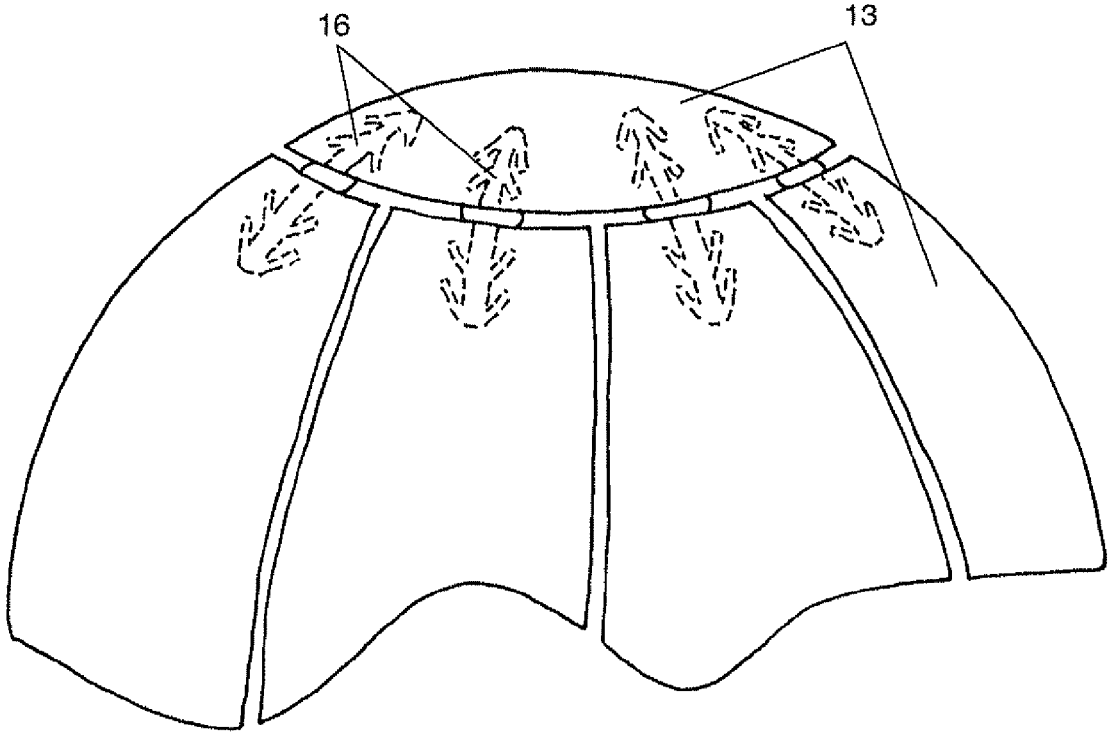

Another solution consists in using a plurality of discrete connecting parts individually performing local joining between two damping elements 13. In the case where the damping liner is formed by a top damping element around which a plurality of lateral, front and rear damping elements are angularly arranged, each connecting part performs connection between the top damping element and a peripheral damping element. In FIG. 4, each connecting part is in the form of a loop 15 formed by closing a band made from textile or from self-grip material of Velcro® type. One end of loop 15 passes through a passage opening arranged in the top damping element, and the opposite end passes through a passage opening of the peripheral damping element joined thereto. In FIG. 6 on the other hand, each connecting part is formed by an insert 16 between two axially offset parts. Each part is designed to collaborate either with the top damping element or with a peripheral damping element, and comprises for this purpose of plurality of anti-return tabs in the form of a fir-tree.

The whole surface of damping elements 13 arranged along the periphery of the opening 11 facing towards shell 12 is positioned against the inner surface of shell 12 so as to form a supporting belt bordering the periphery of the opening and completely in contact with the shell. The whole of the surface facing shell 12 of each damping element 13 forming the supporting belt is therefore completely in contact with the inner surface of shell 12 when the user's head is in position in the cavity of the helmet. In order to form a supporting belt bordering the whole of the periphery of opening 11 so as to avoid empty spaces along the periphery of opening 11, damping elements 13 arranged at the periphery of opening 11 can be positioned side-by-side or placed at a negligible distance of a few millimeters. The supporting belt is in the shape of a ring internally delineating the outline of opening 11. Externally, the supporting belt is completely in contact with the inner surface of shell 12, guaranteeing the absence of dead volumes located between shell 12 and damping elements 13 constituting the belts so as to provide optimum protection.

The shape, size and thickness of shell 12, and the thickness of damping elements 13 constituting the supporting belt, are chosen such that the inner dimensions of the supporting belt (delineating the periphery of opening 11) are perfectly adjusted to the required perimeter of the head in the contact zone scheduled for the head. The helmet is hereby arranged in such a way that positioning of the head in the cavity of the helmet causes deformation of the supporting belt resulting in an elastic flectional deformation of the shell generating permanent tightening of the supporting belt against the head in substantially uniform manner along the supporting belt by flexible biasing of the shell to return to its natural configuration (before the head was positioned in the cavity of the helmet).

Whatever the joining means between damping elements 13, securing of the damping liner to the inner surface of shell 12 can be performed by fixing at least one damping element 13 of the liner to the shell. Such fixing means can be designed to allow a slight sliding between shell 12 and fixed damping elements 13. This slight sliding between damping elements 13 and shell 12, and the movements between damping elements 13, can generate potentially unpleasant noises against which it is possible to act by covering the inner surface of the shell and/or the damping elements with a coating of light felt, spray, or silicone type, or such like.

In the case where the damping liner is formed by a top damping element around which a plurality of lateral, front and rear damping elements are angularly arranged, a first solution consists in using fixing means performing securing of the top damping element with the inner surface of shell 12. In a second solution, helmet 10 comprises means for integrally fixing the damping elements constituting the supporting belt to shell 12 so that the supporting belt is completely secured to the inner surface of shell 12. It should then preferably be provided for the means for integrally fixing the damping elements constituting the supporting belt to shell 12 to allow a slight amount of sliding between shell 12 and the fixed damping elements. This characteristic can be obtained by using securing means of Velcro® self-grip band type or of cooperating loop/hook type, and presents the advantage of better adjustment of the damping elements to the morphology of the head.

In an alternative embodiment improving the comfort at the level of the contact between the supporting belt and the head, compressible elements 17 can be arranged on the surface opposite the surface of the damping elements constituting the supporting belt fixed to shell 12. Such compressible elements 17 can cover the whole or a part of the circumference of the supporting belt, and are made from strong flexible foam, for example from vinyl ethylene acetate, either added-on or provided when the damping elements of the supporting belt are manufactured. Such compressible elements 17 have the function of creating a complementary belt enabling a head having a larger circumference to be positioned inside a helmet provided for a given head circumference, by deformation of compressible elements 17.

Furthermore, filling elements can be arranged to fill the gaps between damping elements 13 over the whole or a part of the damping liner. Such filling elements can be made from any suitable strong flexible material, for example from vinyl ethylene acetate.

Figure 11:
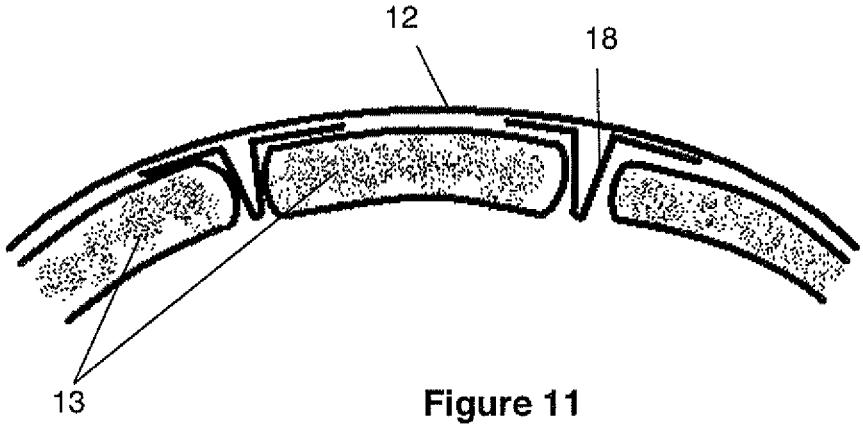
FIG. 11 is a cross-section of a helmet comprising separating elements.

According to an embodiment that is in no way restrictive, the filling elements arranged between damping elements 13 can be formed by separating elements 18. As illustrated in FIG. 11, such separating elements 18 can be formed by flexible connectors adopting a general V-shape the purpose of which is to permanently maintain a minimum space at rest between each of damping elements 13. By deformation of the flexible connectors due to the effect of external forces, this minimum space can temporarily decrease and then return to its natural size by flexible return of the connectors to their natural rest configuration when the external forces cease. This embodiment is particularly advantageous in the case of absence of compressible elements 17.

In addition to creating sliding between shell 12 and damping elements 13, separating elements 18 present a first advantage of guaranteeing that a placing effect of damping elements 13 against the inner surface of shell 12 is constantly maintained, eliminating any mobility of elements 13, in particular so long as the helmet is not used. They further facilitate deformations of the assembly formed by the shell and by the segmented liner by fostering sliding.

Finally, they enable noises and gratings caused by contact between elements 13 and between the elements and shell 12 to be eliminated. Separating elements 18 can be obtained by thermoforming or by injection of material (for example PE or PP).

Helmet 10 can further comprise a chinstrap connected at its ends to two opposite damping elements each belonging to the supporting belt.

Figure 7:
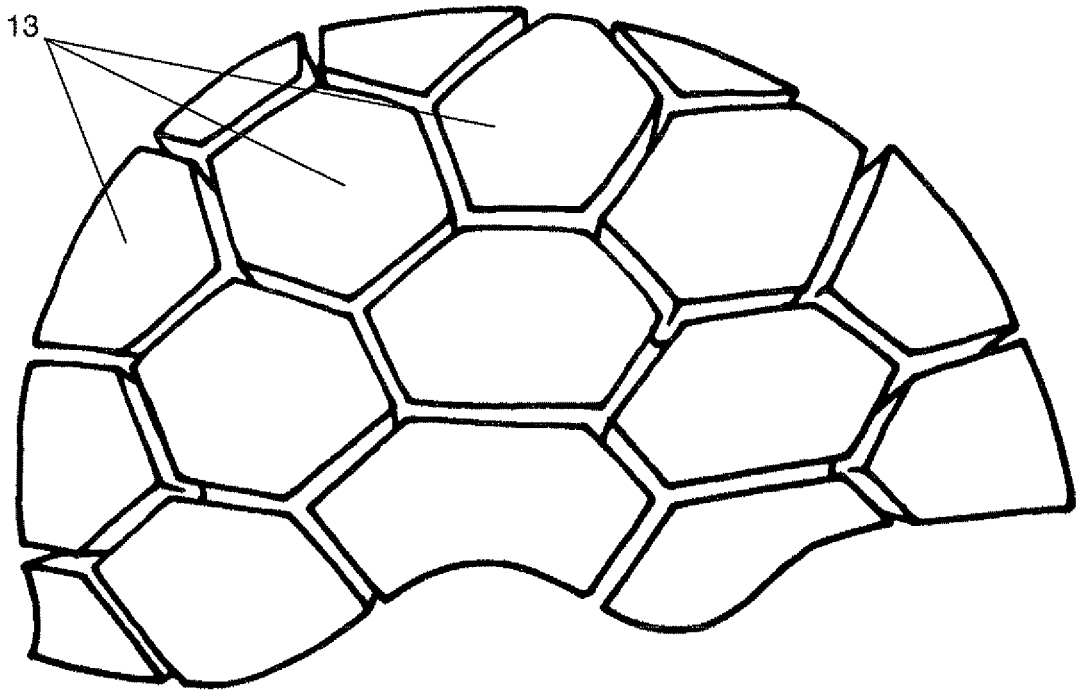
FIGS. 7 to 10 represent different alternative embodiments of the shape of the damping elements.
Figure 8:
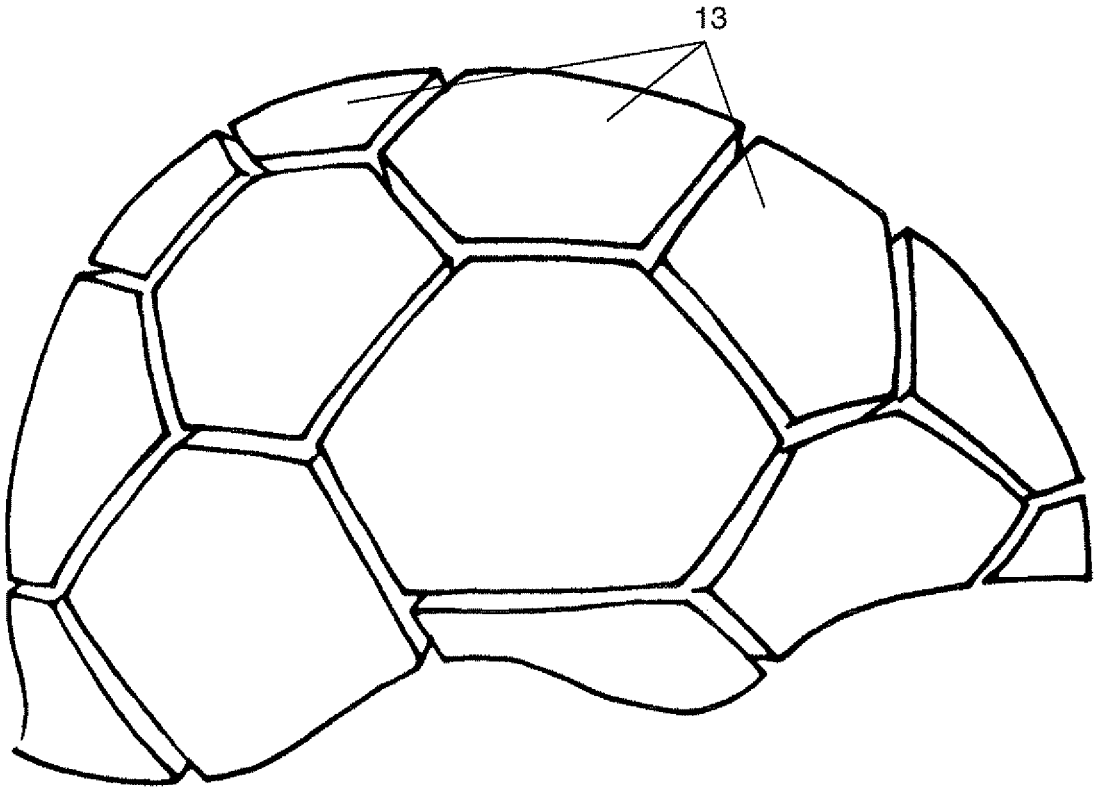
Figure 9:
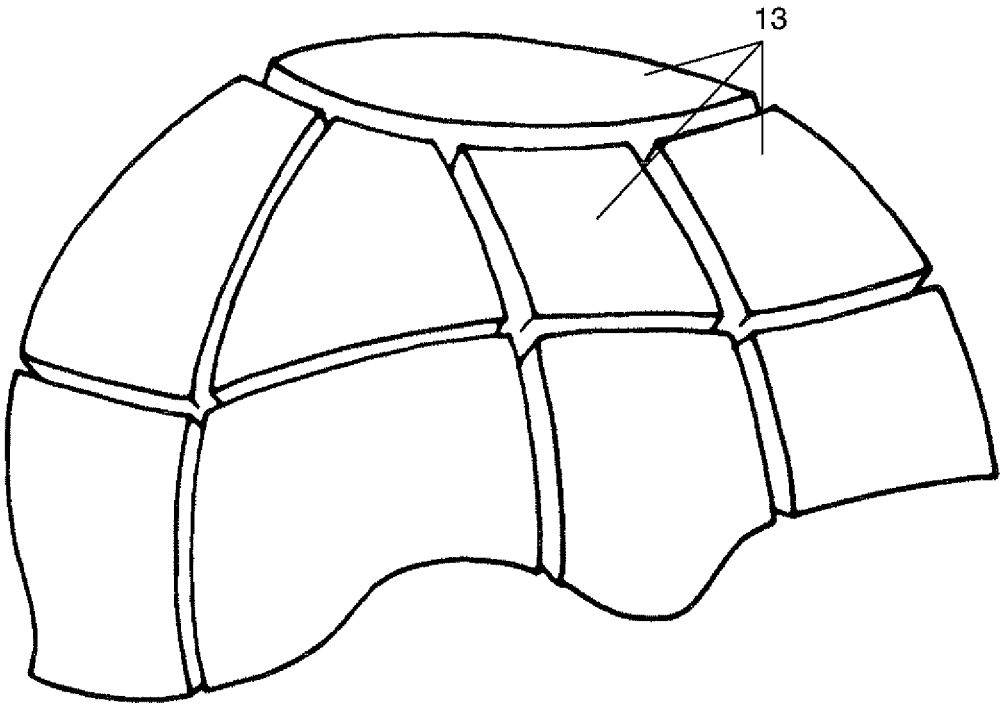
Figure 10:
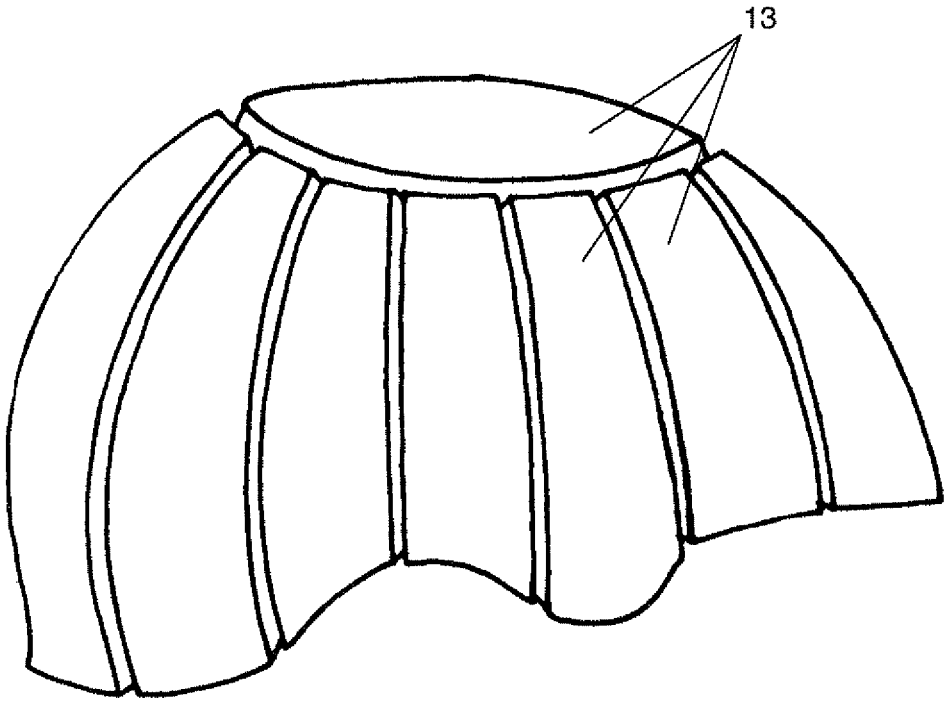

The purpose of FIGS. 7 to 10 is to illustrate the different shape variants that damping elements 13 of the damping liner are able to take. In FIG. 10, a top damping element is connected to a plurality of lateral, front and rear damping elements arranged at the periphery of the top damping element. FIG. 9 is a variant of FIG. 10 wherein the peripheral damping elements are subdivided into two independent elements offset in the direction of the bottom of the cavity. FIGS. 7 and 8 on the other hand represent a liner where damping elements 13 are hexagonal and distributed uniformly over the whole inner surface of shell 12, with a respectively large and smaller distribution density.

All of the alternative embodiments of the helmet describing in the foregoing present the advantage of a great quality of ventilation inside the helmet. The heat originating from the user's head is in fact mainly radiation on the circumference of the skull. The slits or gaps between elements 13 create an air flow network enabling efficient removal of heat and moisture. This effect can be enhanced if shell 12 is provided with holes opening out on the outside and facilitating creation of a variable ventilation draught according to the mobility of the user.

Finally, as far as safety is concerned, the embodiments described in the foregoing where lateral damping elements 13 are floating enable a part of the energy to be absorbed by sliding and pivoting between the head and the shell in the case of tangential force components. This movement of a few tens of millimeters is capital to enable the stress peak to be absorbed and to remain below the threshold of damage to the brain. In the case of a greater stress force, sliding in the plane of the supporting belt between the head and helmet is possible to dampen the shock wave. This possibility is allowed due to the free deformation of the perimeter of the supporting belt.

In an advantageous alternative embodiment, the means for fixing top damper element 13 and shell 12 can act as a fuse element and enable the two elements to be at least partially disunited from one another, enabling a larger rotation of the shell with respect to the liner, making transmission of forces almost nil. Such a fixing means can be achieved with glue, for example of hot melt glue type, or a magnet or with a self-grip material of Velcro® type. Shell 12 cannot disunite as the chinstrap or equivalent under the user's chin guarantees the unity of the whole.

The invention claimed is:

1. A safety helmet comprising:

a cavity open onto the outside through an opening to engage a head of a user in the cavity;

an outer shell in a single part, and made from elastically deformable material, having a modulus of elasticity between 1500 and 4500 MPa;

a plurality of damping elements added-on to the inside of the shell, wherein the damping elements are formed by a rigid foam, and the damping elements are arranged at the periphery of the opening against the inner surface of the shell to form an inner supporting belt completely in contact with the shell; and joining means to join the damping elements to one another, to allow relative movements between the damping elements, wherein a position of the head of the user in the cavity causes a deformation of the supporting belt by elastic deformation of the shell according to the morphology of the head of the user, generating permanent tightening of the supporting belt against the head of the user in a substantially uniform manner along the supporting belt, wherein the joining means comprises a single structure connecting the set of damping elements to one another, wherein the single structure is in the form of a spider, the head of which is fixed to a top damping element and each leg of which performs joining between the top damping element and a peripheral damping element, and wherein the top and peripheral damping elements are obtained by overmolding on the single structure.

2. The helmet according to claim 1, comprising means for integrally fixing the damping elements constituting the supporting belt to the shell.

3. The helmet according to claim 2, wherein the means for integrally fixing the damping elements constituting the supporting belt to the shell allow a slight sliding between the shell and the fixed damping elements.

4. The helmet according to claim 1, wherein the thickness of the outer shell is comprised between 0.5 and 3 mm.

5. The helmet according to claim 1, wherein compressible elements are arranged on the surface opposite the surface of the damping elements constituting the supporting belt fixed to the shell.

* * * * *